US009314145B2

(12) United States Patent
Durham et al.

(10) Patent No.: US 9,314,145 B2
(45) Date of Patent: Apr. 19, 2016

(54) DISHWASHING APPLIANCE AND VENT FOR DISHWASHING APPLIANCE

(71) Applicant: General Electric Company, Schenectady, NY (US)

(72) Inventors: Kyle Edward Durham, Louisville, KY (US); John Edward Dries, Louisville, KY (US)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 14/034,783

(22) Filed: Sep. 24, 2013

(65) Prior Publication Data

US 2015/0083170 A1 Mar. 26, 2015

(51) Int. Cl.
*A47L 15/42* (2006.01)

(52) U.S. Cl.
CPC ..... *A47L 15/4204* (2013.01)

(58) Field of Classification Search
None
See application file for complete search history.

(56) References Cited

U.S. PATENT DOCUMENTS

| | | | | |
|---|---|---|---|---|
| 1,823,583 | A * | 9/1931 | Biskamp | 134/177 |
| 5,700,329 | A * | 12/1997 | Edwards et al. | 134/10 |
| 5,779,812 | A * | 7/1998 | Thies | A47L 15/4208 134/10 |
| 7,610,923 | B2 | 11/2009 | Hedstrom et al. | |
| 8,066,821 | B2 * | 11/2011 | Hedstrom et al. | 134/56 D |
| 2003/0029478 | A1 * | 2/2003 | Hegeman | A47L 15/4204 134/10 |
| 2003/0034650 | A1 * | 2/2003 | Krauss et al. | 285/206 |
| 2011/0290719 | A1 * | 12/2011 | Mathew et al. | 210/512.3 |

* cited by examiner

*Primary Examiner* — Michael Barr
*Assistant Examiner* — Cristi Tate-Sims
(74) *Attorney, Agent, or Firm* — Dority & Manning, P.A.

(57) ABSTRACT

A dishwasher appliance and a vent for coupling a filter and a sump together are provided. The dishwasher appliance includes a cabinet defining a wash chamber for the receipt of articles for washing, and a sump for collection of a fluid from the wash chamber. The sump includes a base wall and a collar extending from the base wall. The dishwasher appliance further includes a filter for filtering the fluid from the wash chamber. The dishwasher appliance further includes a vent coupling the filter and the sump together, the vent comprising a shaft, the shaft including at least one sidewall. The at least one sidewall defines a main shaft passage therein. The shaft further defines a shaft access passage extending through the sidewall and in fluid communication with the main shaft passage. A collar access passage defined in the collar and the main shaft passage are in fluid communication.

15 Claims, 6 Drawing Sheets

FIG. —1—

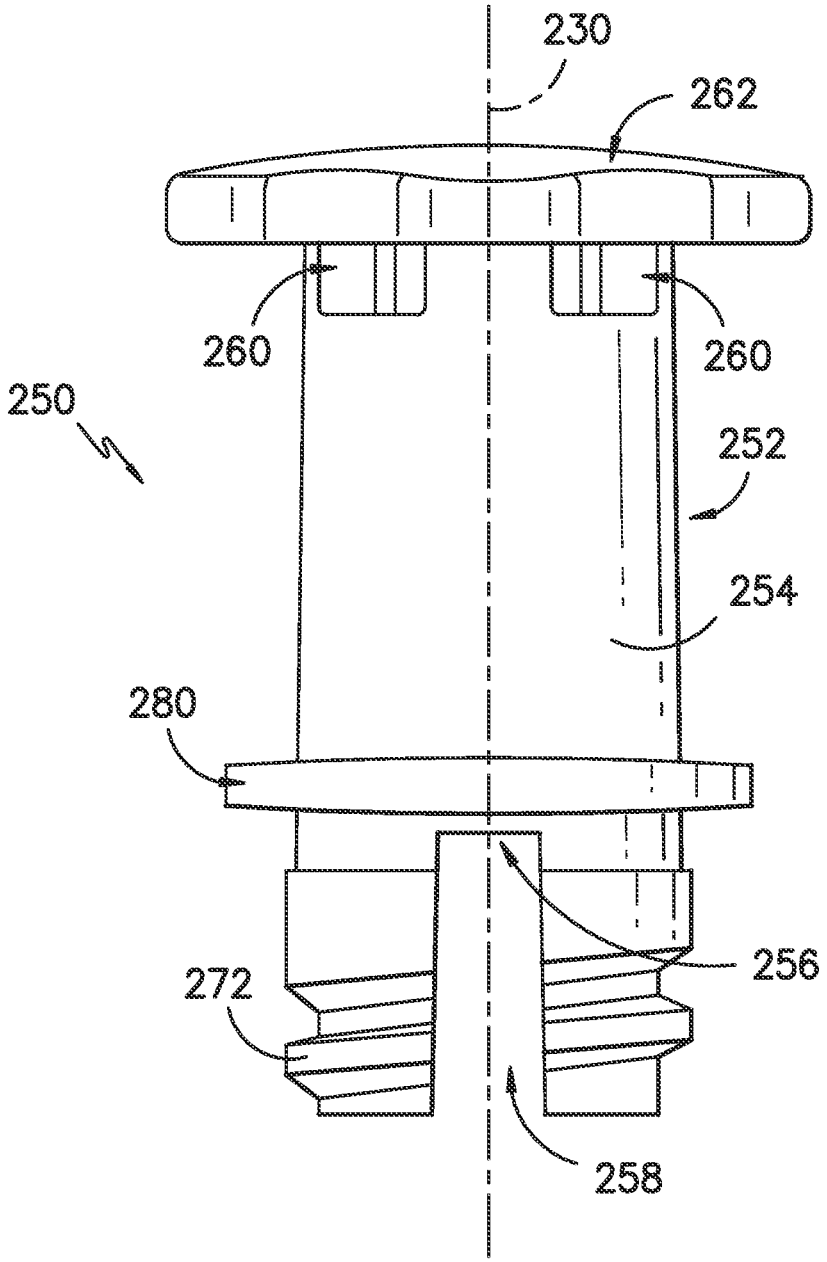
FIG. —5—

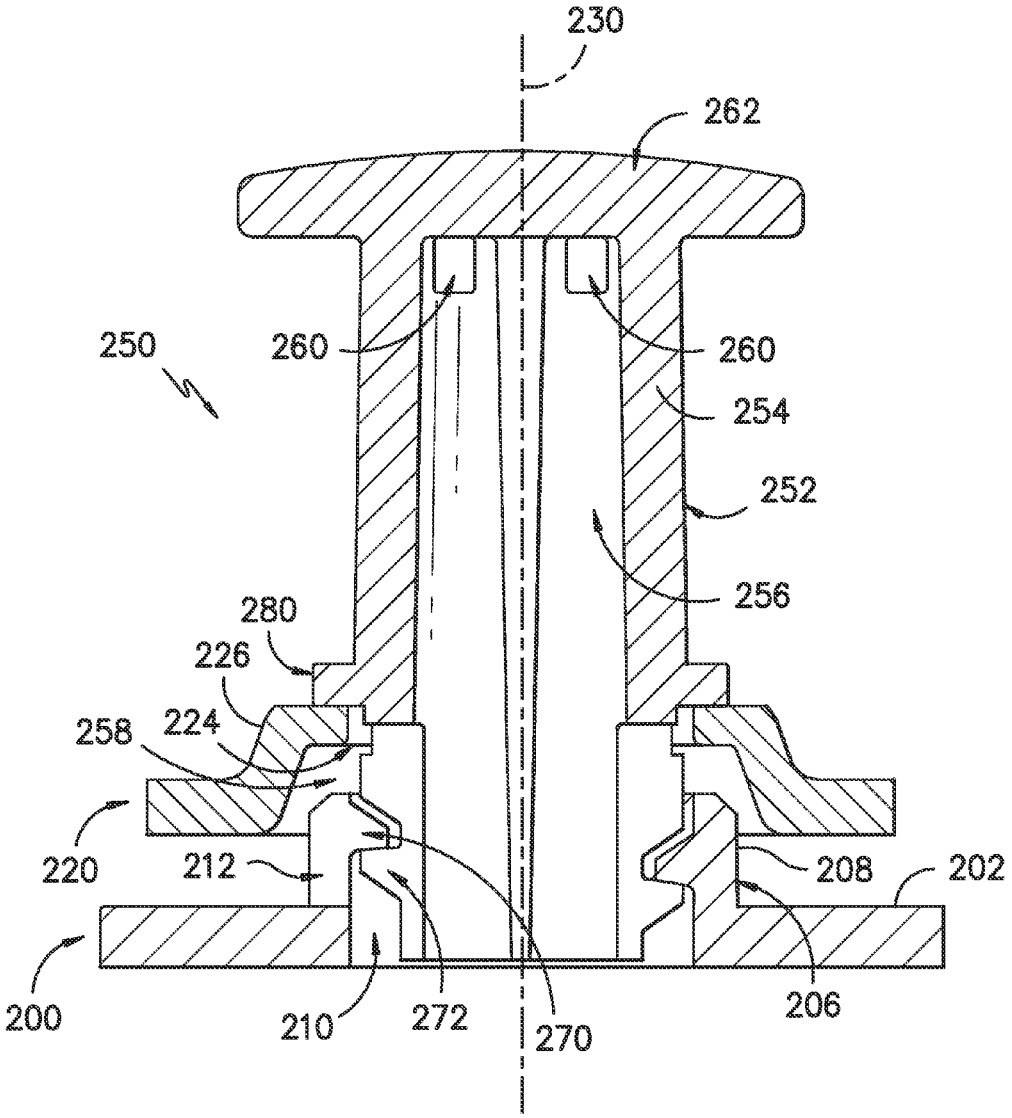
FIG. —6—

DISHWASHING APPLIANCE AND VENT FOR DISHWASHING APPLIANCE

FIELD OF THE INVENTION

The present disclosure relates generally to dishwashing appliances, and more particularly to improved vents for use in dishwashing appliance.

BACKGROUND OF THE INVENTION

During wash and rinse cycles, dishwashing appliances typically circulate a fluid through the wash chamber and over articles such as pots, pans, silverware, and other cooking utensils. The fluid can be e.g., various combinations of water and detergent during the wash cycle or water (which may include additives) during the rinse cycle. Typically the fluid is recirculated during a given cycle using a pump. Fluid is collected at or near the bottom of the wash chamber and pumped back into the chamber through e.g., nozzles in the spray arms and other openings that direct the fluid against the articles to be cleaned or rinsed.

Depending upon the level of soil upon the articles, the fluid will become contaminated with the soil in the form of debris and particles that are carried with the fluid. In order to protect the pump and make sure the fluid can continue to recirculate through the wash chamber, the fluid is typically filtered during its movement between the wash chamber and the pump so that relatively clean fluid is supplied to the pump inlet. In addition to pump protection, such filtration also helps to clean the articles by removing soil from the fluid.

Accordingly, typical dishwashers include a sump for collection of fluid from the dishwasher wash chamber. The sump may be in fluid communication with the pump. Further, a filter, generally known as a coarse filter, may be provided adjacent the sump, to filter the fluid before it is provided to the sump.

However, a variety of problems have arisen with many currently known dishwasher appliances due to the use of such filters. For example, such filters require occasional cleaning, during which the user of the dishwasher is expected to remove the filter. However, many known filters utilize mechanical fasteners to hold the filters in place in the dishwashing appliance which require the consumer to utilize various tools to remove the filter. Further, during operation of a dishwashing appliance, air can become trapped below the filter. Known vents for allowing this trapped air to escape from the filter require addition, separate attachment to the dishwashing appliance, thus requiring the user to separately remove the vent. These disadvantages can lead users to neglect to clean the filter, resulting in inefficiency of and damage to the dishwashing appliance.

Accordingly, improved vents and improved apparatus for coupling filters within dishwashing appliances are desired in the art. Specifically, the elimination of separate fasteners for coupling such filters, and improved venting components, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a dishwasher appliance is provided. The dishwasher appliance includes a cabinet defining a wash chamber for the receipt of articles for washing, and a sump for collection of a fluid from the wash chamber. The sump includes a base wall and a collar extending from the base wall, the collar including at least one sidewall, the at least one sidewall defining a main collar passage therein. The collar further defines a collar access passage extending through the sidewall and in fluid communication with the main collar passage. The dishwasher appliance further includes a filter for filtering the fluid from the wash chamber, the filter defining an opening, the opening generally aligned with the main collar passage. The dishwasher appliance further includes a vent coupling the filter and the sump together, the vent comprising a shaft, the shaft including at least one sidewall. The at least one sidewall defines a main shaft passage therein. The shaft further defines a shaft access passage extending through the sidewall and in fluid communication with the main shaft passage. The collar access passage and the main shaft passage are in fluid communication.

In accordance with another embodiment of the present disclosure, a vent is provided for coupling a filter and a sump together in a dishwasher appliance. The vent includes a shaft, the shaft including at least one sidewall. The vent further includes a main shaft passage defined in the shaft, and a shaft access passage extending through the sidewall and in fluid communication with the main shaft passage. The vent further includes a means for connecting the shaft to the sump, and a means for coupling the filter between the shaft and the sump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 is a side view of a vent in accordance with one embodiment of the present disclosure; and FIG. 6 is a cross-sectional view of a vent and a filter connected and coupled, respectively, to a sump in accordance with one embodiment of the present disclosure.

DETAILED DESCRIPTION OF THE INVENTION

Figure 1:
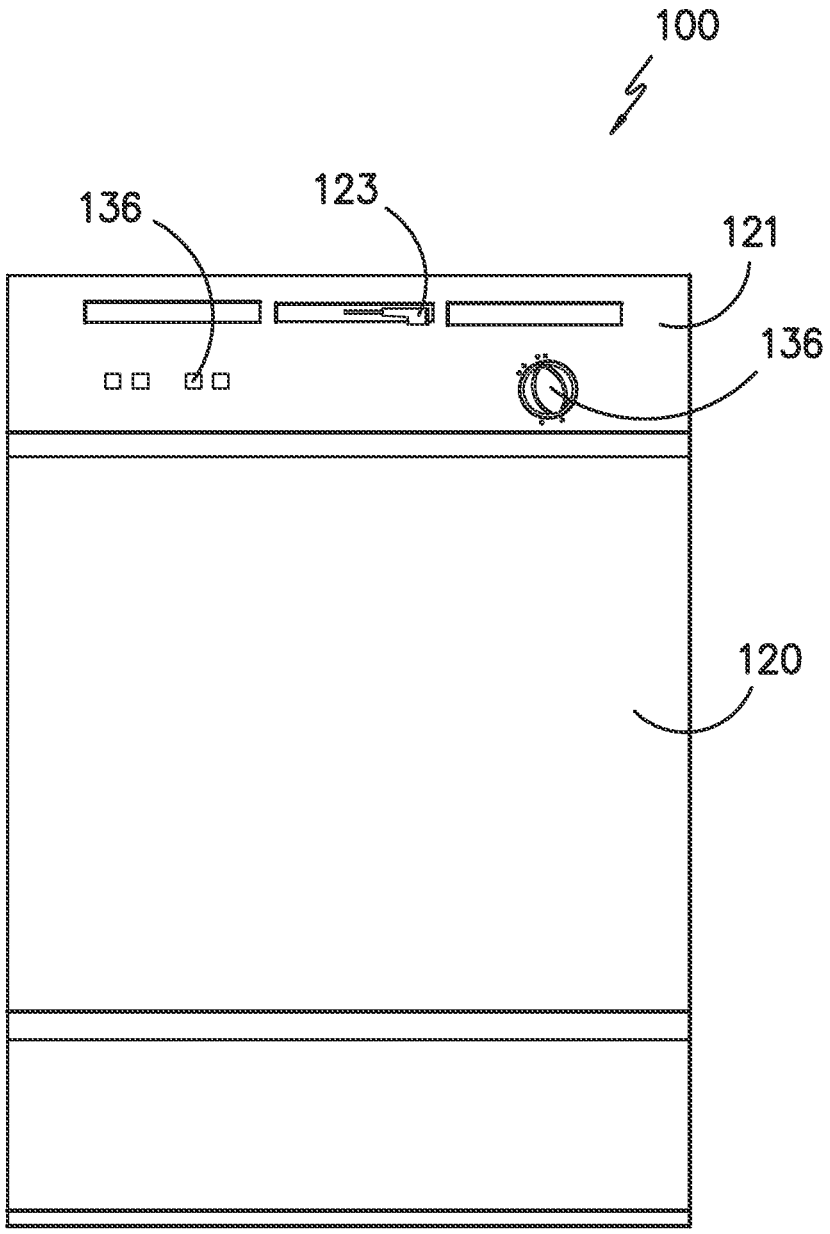
FIG. 1 provides a front view of a dishwashing appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements that were retained by the articles after completion of the wash cycle. The term "fluid" refers to a liquid used for washing and/or rinsing the articles and is typically made up of water that may include other additives such as detergent or other treatments.

Figure 2:
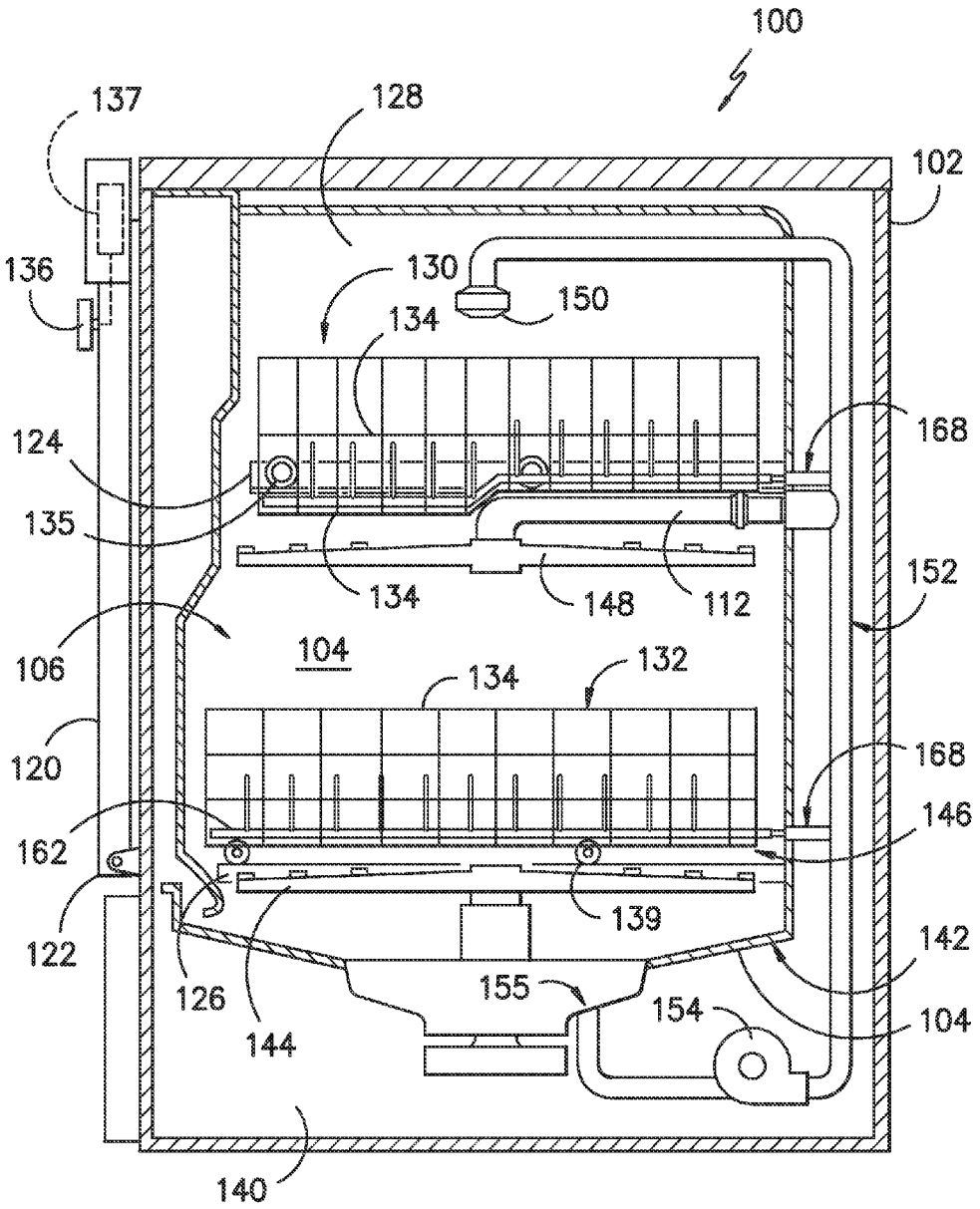
FIG. 2 is a cross-sectional view of a dishwashing appliance in accordance with one embodiment of the present disclosure.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Figure 3:
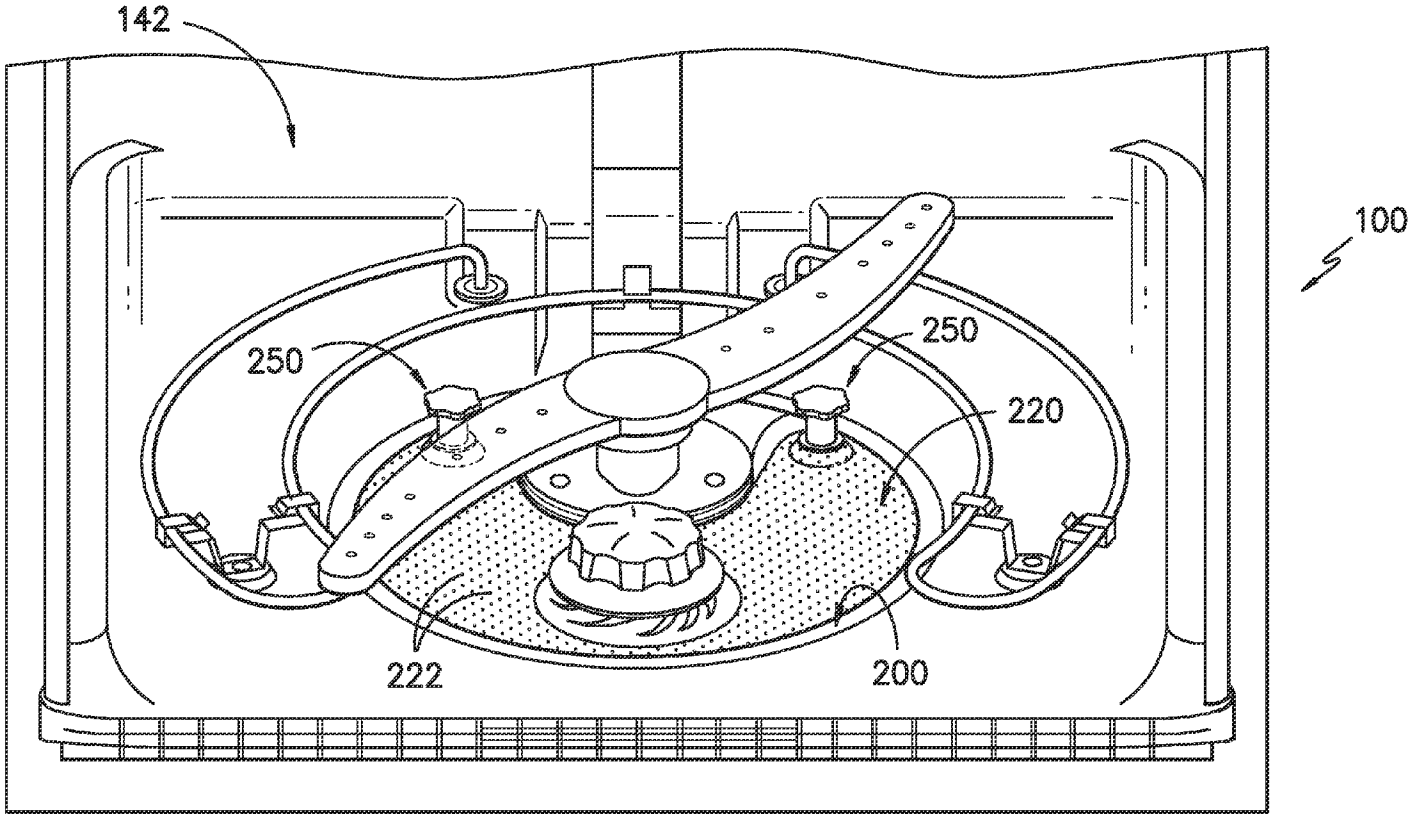
FIG. 3 is a perspective view of a filter and a plurality of vents positioned within a dishwashing appliance in accordance with one embodiment of the present disclosure.
Figure 4:
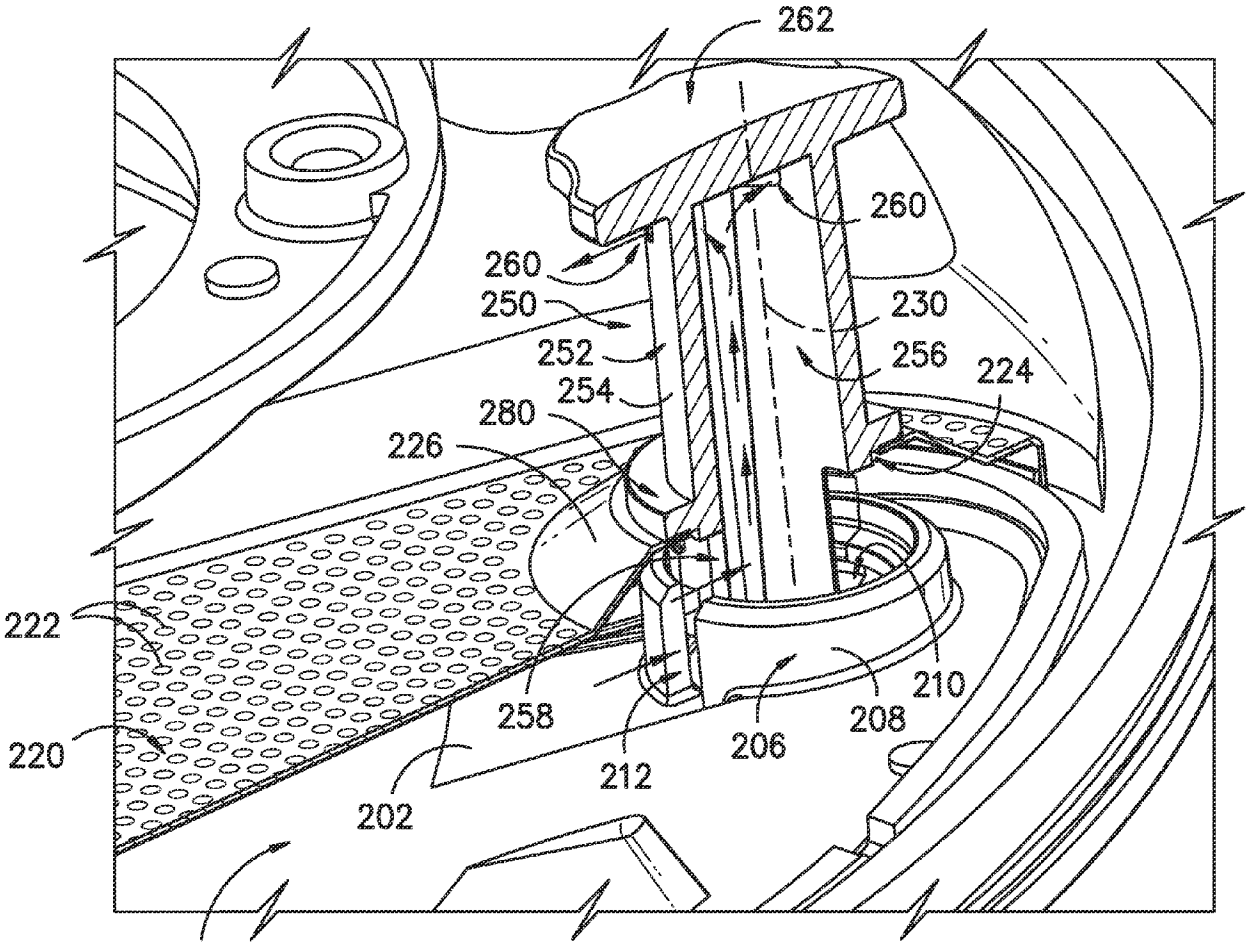
FIG. 4 is a partial cross-sectional view of a vent and a filter connected and coupled, respectively, to a sump in accordance with one embodiment of the present disclosure.

Referring now to FIGS. 3, 4 and 6, various embodiments of sump portion 142 are provided. Sump portion 142 generally collects and filters the fluid, and provides the fluid for recirculation through the wash chamber 106 during operation of the dishwasher.

For example, sump portion 142 may include a sump 200. The sump 200 may collect fluid from the wash chamber 106. Sump 200 may, for example, include a base wall 202. Base wall 202 may generally be angled to allow fluid collected by the sump 200 to flow in a certain direction, such as towards an opening defined therein (for example, a pump inlet, etc.). Such opening may, for example, provide fluid communication for the sump 200 with a pump, as discussed herein. Sump 200 may additionally include one or more collars 206 extending from the base wall 202. As shown, a collar 206 may include at least one sidewall 208. In exemplary embodiments, for example, a collar 206 includes a single generally circular (in cross-sectional shape) sidewall 208 which generally forms a tube shape. A main collar passage 210 may be defined within the sidewall(s) 208, as shown. Additionally, collar 206, such as the at least one sidewall 208 thereof, may define a collar access passage 212. The collar access passage 212 may extend through one or more sidewalls 208, and be in fluid communication with the main collar passage 210 as shown.

Sump portion 142 may further include a filter 220. Filter 220 filters the fluid from the wash chamber 106 before it is collected by the sump 200. As shown, for example, filter 220 may be constructed as a grate located in the sump portion 142, and may define a plurality of relatively large apertures 222 therein which allow the fluid and particles smaller than apertures 222 to pass through. Filter 220 may further include one or more openings 224, which may be larger than apertures 222. Each opening 224 may be positioned in the filter 220 to be generally aligned with the main collar passage 210, and may accommodate therein a vent shaft as discussed herein. Such alignment may, for example, generally be along a longitudinal axis 230 extending through the main collar passage 210 and the opening 224. Further, in some embodiments as shown, one or more sidewalls 226 may extend from the filter 220 and define the opening 224 therebetween. Such sidewalls 226 may thus offset (by raising as shown or lowering) the opening 224 relative to the remainder of the filter 220. In exemplary embodiments, a single circular (in cross-section) sidewall 226 may define the opening 224.

Referring again to FIG. 2, in some embodiments, a sump portion 142 further includes a pump 154. After the fluid is filtered and collected, it is fed to the inlet 155 of pump 154 for return to the wash chamber 106 by way of fluid circulation assembly 152. Accordingly, filter 220 and sump 200 act to clean soil particles from the fluid and protect pump 154 from clogging as the fluid is recirculated during e.g., a wash or rinse cycle of dishwasher 100. Fluid from e.g., sprays arms 144 and 148 as well as spray assembly 150 travels over articles in wash chamber 106 and down to sump portion 142 carrying soil particles from the articles. The fluid is filtered by filter 220. The filtered fluid is flowed in the sump 200 to the inlet 155 of pump 154 for recirculation.

As discussed, improved apparatus for providing filter 220 venting and attachment within a dishwashing appliance are desired. Accordingly, the present disclosure is further directed to vents 250 as shown in FIG. 3 through 6. One or more vents 250 may be included in a dishwashing appliance 100 and disposed in the sump portion 142 thereof. Each vent 250 may couple the filter 220 and sump 200 together, and may further provide advantageous venting of the filter 220 as discussed herein.

As shown, a vent 250 may include a shaft 252. Shaft 252 may include at least one sidewall 254. In exemplary embodiments, for example, a shaft 252 includes a single generally circular (in cross-sectional shape) sidewall 254 which generally forms a tube shape. A main shaft passage 256 may be defined within the sidewall(s) 254, as shown. Additionally, shaft 252, such as the at least one sidewall 254 thereof, may define a shaft access passage 258. The shaft access passage 258 may extend through one or more sidewalls 254, and be in fluid communication with the main shaft passage 256 as shown.

As shown, the shaft 252 may extend through the filter opening 224 and into the collar 206, such as along longitudinal axis 230. Thus, the collar access passage 212 and main shaft passage 256 may be in fluid communication, thus allowing for venting of the filter 220 through the shaft 252. For example, air trapped between the filter 220 and sump 200 may flow through the collar access passage 212 into the main collar passage 210. As discussed, shaft 252 may be disposed within the main collar passage 210. Thus, air may then flow from the main collar passage 210 through the shaft access passage 258 into the main shaft passage 256.

Further, in some embodiments, air may flow directly out of the main shaft passage 256. In other embodiments, the vent 250 may further include a vent passage 260, which may be defined in and extend through one or more sidewalls 254 of the shaft 252. Vent passage 260 may be in fluid communication with the main shaft passage 256. Air may flow from the main shaft passage 256 through the vent passage 260 to escape from the vent 250. Additionally, in some embodiments, the vent 250 may further include a cap 262. Cap 262 may be connected to the shaft 252, and may prevent air from escaping directly from the shaft 252, rather redirecting such air to the vent passage 260.

It should be understood that the vent passage 260 and shaft access passage 258 may be spaced apart along the length of the shaft 252, such as along the longitudinal axis 230 when the vent 250 is connected in the sump portion 142. For example, when the vent 250 is installed and extending through the opening 224 and collar 206, shaft access passage 258 may be disposed between the filter 220 and sump 200, and thus "below" the filter 220 according to a conventional orientation of the dishwashing appliance 100, while the vent passage 260 may be "above" the filter 220, thus allowing air flowing through the shaft 252 to escape from below the filter 220.

In exemplary embodiments as shown, the vent passage 260, shaft access passage 258, and/or collar access passage 212 may be slots defined in the respective sidewalls, as shown. In other embodiments, one or more of these passages 260, 258, 212 may be bore holes, etc., or have any other suitable shape or configuration.

A vent 250 may further include, for example, means for connecting the shaft 252 to the sump 200, such as to the collar 206 thereof. In exemplary embodiments, for example, the vent 250 is removably connected to the collar 206. As shown, in one embodiment, the collar 206 may include one or more inner threads 270, which may extend from the at least one sidewall 208 of the collar 206. The shaft 252 may include one or more outer threads 272, which may extend from the at least one sidewall 254 thereof. The outer threads 272 may threadably engage the inner threads 270 when the shaft 252 is extended through the collar 206, thus connecting the shaft 252 to the sump 200.

In other embodiments, other suitable connection apparatus may be utilized to connect the shaft 252 to the sump 200. For example, a mechanical fastener, such as a screw, rivet, nut/bolt combination, etc., may be extended through the shaft 252 and connected to the base wall 202 of the sump 200 to connect the shaft 252 and sump 200. In embodiments wherein the vent 250 includes a cap 262, the mechanical fastener may additionally extend through the cap 262. Alternatively, snap-fit or quick release arrangements may be utilized, with the mating components disposed on and/or extending from the collar 206 and shaft 252.

A vent 250 may further include, for example, means for coupling the filter 220 between the shaft 252 and the sump 200. Thus, the vent 250 may be utilized to attach the filter 220 within the dishwasher appliance 100, without the need for separate, additional components. As shown, in one embodiment, a lip 280 may extend from the shaft 252. The lip 280 may extend outwardly, such that a width (aka diameter) of the lip 280 is greater than a width of the shaft 252. The lip 280 may extend peripherally around the shaft 252 as shown, or may be formed from a plurality of lip components 280 spaced apart or in contact about the periphery of the shaft 252. The lip 280 width may further be greater than a width of the opening 224 of the filter 220. Thus, when the vent 250 is coupled to the sump 200, the lip 280 may contact filter 220 and couple the filter 220 in place between the shaft 252 and sump 200. Filter 220 may thus be fastened within the sump portion 142 of the dishwasher assembly 100. Further, removal of the filter 220 may require only unconnecting of the vent 250, without the requirement for removing separate, additional components.

It should be understood that lip 280 may be disposed between the shaft access passage 258 and vent passage 260, such as along longitudinal axis 230 when the vent 250 is installed. Further, when vent 250 is installed, lip 280 may remain above filter 220, and may contact and press down upon filter 220 to couple the filter 220 between the shaft 252 and sump 200.

In other embodiments, other suitable coupling apparatus may be utilized to couple the filter 220 between the shaft 252 and the sump 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a cabinet defining a wash chamber for the receipt of articles for washing;

a sump for collection of a fluid from the wash chamber, the sump comprising a base wall and a collar extending from the base wall, the collar comprising at least one sidewall, the at least one sidewall defining a main collar passage therein, the collar further defining a collar access passage extending through the sidewall and in fluid communication with the main collar passage;

a filter for filtering the fluid from the wash chamber, the filter defining an opening, the opening generally aligned with the main collar passage;

a vent coupling the filter and the sump together, the vent comprising a shaft, the shaft comprising at least one sidewall, the at least one sidewall defining a main shaft passage therein, the shaft further defining a shaft access passage extending through the sidewall and in fluid communication with the main shaft passage, wherein the shaft extends through the opening and the main collar passage and the collar access passage and the main shaft passage are in fluid communication.

2. The dishwasher appliance of claim 1, wherein the vent further comprises a vent passage extending through the at least one sidewall of the shaft and in fluid communication with the main shaft passage.

3. The dishwasher appliance of claim 1, wherein the vent further comprises a cap connected to the shaft.

4. The dishwasher appliance of claim 1, wherein the vent is removably connected to the collar.

5. The dishwasher appliance of claim 1, wherein the at least one sidewall of the collar comprises an inner thread and the at least one sidewall of the shaft comprises an outer thread engageable with the inner thread.

6. The dishwasher appliance of claim 1, wherein a lip extends from the shaft, the lip having a width greater than a width of the opening.

7. The dishwasher appliance of claim 1, wherein the at least one sidewall of the collar and the at least one sidewall of the vent are each single generally circular sidewalls.

8. The dishwasher appliance of claim 1, wherein the collar access passage and the shaft access passage are each a slot.

9. The dishwasher appliance of claim 1, further comprising a pump for the receipt of the fluid from the sump, the pump configured to recirculate the fluid into the wash chamber of the cabinet, the pump having an inlet in fluid communication with the sump.

10. A dishwasher appliance, comprising:

a cabinet defining a wash chamber for the receipt of articles for washing;

a sump for collection of a fluid from the wash chamber, the sump comprising a base wall and a collar extending from the base wall, the collar comprising at least one sidewall, the at least one sidewall defining a main collar passage therein and comprising an inner thread, the collar further defining a collar access passage extending through the sidewall and in fluid communication with the main collar passage;

a filter for filtering the fluid from the wash chamber, the filter defining an opening, the opening generally aligned with the main collar passage;

a vent coupling the filter and the sump together, the vent comprising a shaft and a lip extending from the shaft, the shaft comprising at least one sideWall, the at least one sidewall defining a main shaft passage therein and comprising an outer thread engageable with the inner thread, the shaft further defining a shaft access passage extending through the sidewall and in fluid communication with the main shaft passage, the lip having a width greater than a width of the opening, wherein the shaft extends through the opening and the main collar passage and the collar access passage and the main shaft passage are in fluid communication.

11. The dishwasher appliance of claim 10, wherein the vent further comprises a vent passage extending through the at least one sidewall of the shaft and in fluid communication with the main shaft passage.

12. The dishwasher appliance of claim 10, wherein the vent further comprises a cap connected to the shaft.

13. The dishwasher appliance of claim 10, wherein the vent is removably connected to the collar.

14. The dishwasher appliance of claim 10, wherein the at least one sidewall of the collar and the at least one sidewall of the vent are each single generally circular sidewalls.

15. The dishwasher appliance of claim 10, wherein the collar access passage and the shaft access passage are each a slot.

* * * * *